US006361139B1

(12) United States Patent
Gómez et al.

(10) Patent No.: US 6,361,139 B1
(45) Date of Patent: Mar. 26, 2002

(54) SELF-CALIBRATED SENSOR MODULE FOR INKJET PRINTING DEVICES

(75) Inventors: Jordi M. Gómez, Barcelona; Carlos Pardo, Madrid, both of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/495,037

(22) Filed: Jan. 31, 2000

(51) Int. Cl.[7] ..... B41J 29/393; B41J 29/38
(52) U.S. Cl. ..... 347/19; 347/14
(58) Field of Search ..... 347/19, 23, 14, 347/32, 7, 11, 16, 10, 8, 86, 81; 250/202

(56) References Cited

U.S. PATENT DOCUMENTS 5,170,047 A * 12/1992 Beauchamp et al. ..... 347/19

FOREIGN PATENT DOCUMENTS

EP 0 622 237 A2 2/1994 ..... B41J/25/34

* cited by examiner

*Primary Examiner*—Charles W. Stewart, Jr.

(57) ABSTRACT

A selfcalibrated sensor module for inkjet printing devices includes a new circuitry and a new calibration method to provide the best output signal independently of optical component functionality variations and external light source influences.

The circuitry for processing the photodetector output signal is designed to process that signal by a bank of amplifiers or by an amplifier of variable gain and includes an input for adding an offset to the signal.

The calibration system, implemented in a processing unit, calibrates the sensor module, firstly finding the level of light that should be applied to the LEDs to maximize it so as to grant the best signal possible, in terms of the signal to noise ratio (SNR), Secondly, it determines which amplification factor will be used in order to ensure that the resulting sampled signal is not saturated. Thirdly, it determines the necessary offset to be added to the signal to center it in the dynamic margin of the ADCs.

17 Claims, 9 Drawing Sheets

SELF-CALIBRATED SENSOR MODULE FOR INKJET PRINTING DEVICES

BACKGROUND OF THE INVENTION

1. Field of the Invention

The present invention relates to a sensor module for inkjet printing devices having one or more cartridges for color operation.

2. Description of the Related Art

An ink jet printing mechanism uses cartridges, often called "pens", which shoot drops of liquid colorant, referred to generally herein as "ink', onto a page. Each pen has a printhead formed with very small nozzles through which the ink drops are fired. The ink jet printing mechanisms may be used in different devices such as printers, plotters and the like. For the sake of convenience, in what follows reference will be made only to large format ink jet printers or plotters to illustrate the concepts of the present invention.

Different nozzles are used for different colors. Ink jet printers usually print within a range of 180 to 2400 or more dots per inch. The ink drops are dried upon the printing support soon after being deposited to form the desired printed images.

There are several types of ink jet printheads including, for example, thermal printheads and piezoelectric printheads. By way of example, in a thermal ink jet printhead the ink drops are ejected from individual nozzles by localized heating. Each of the nozzles has a small heating element. An electric current is made to pass through the element to heat it. This causes a tiny volume of ink to be heated and vaporized instantaneously by the heating element. Upon being vaporized, the ink is ejected through the nozzle. An exciter circuit is connected to individual heating elements to supply the energy impulses and, in this manner, to deposit in a controlled way ink drops from associated individual nozzles. These exciter circuits respond to character generators and other imaging circuits to activate selected nozzles of the printhead in order to form the desired images on the printing support.

Thermal inkjet printing is based on accurate ballistic delivery of small ink droplets to exact locations onto the paper or other media. One key factor for sharp and high quality images stems from the accuracy of the droplet placement. Droplet placement inaccuracy results in fact in line discontinuity and roughness, as well as banding and color inconsistencies.

Droplet placement inaccuracies are caused by imperfections and variations of the mechanical and geometrical characteristics of the printer and printhead, as well as their functional performances. The defects caused by droplet placement errors appear in a variety of ways and may depend on the print modes being used (i.e. the sweep velocity of the printhead over the paper and the direction of printing).

Full color printing and plotting requires techniques for correcting different causes of droplet placement inaccuracies. Some of these techniques, using a sensor module for measuring printing errors in appropriate printed patterns, are disclosed in EP 0 622 237.

The sensor module described in said patent includes two light emitting diodes (LEDs), two lenses, a phase plate of an opaque material with transparent squared openings and a photodetector. As the sensor module scans the test pattern, an output signal is provided and examined by an appropriate circuitry to measure the deviation of the printed test pattern with respect to nominal references.

The electrical signal produced by the photodetector is amplified with a fixed gain and the result is sampled with an analog-to-digital converter (ADC). The resulting set of samples from the ADC provides the information required to correct the cause of the inaccuracy by means of techniques of adjusting the time at which a droplet is being ejected.

Using this sensor module, two main problems arise. Firstly, its calibration has only one parameter to play with: the light produced by the LEDs. If it is too large, the resulting electrical signal saturates the ADC and the computed sequence of samples does not reflect the real surface previously scanned. If it does not reach the necessary value, the noise acquired together with the signal render the system totally blind. The calibrated level of light is therefore obtained at the level in which the samples start to saturate the ADC. This calibration method does not ensure the use of the best signal available, in terms of signal to-noise-ratio; therefore failure tolerance to noise is dramatically decreased, specially when LEDs provide very different levels of intensity.

Secondly, since the LEDs and photodetector are tied to the gain of the amplifier and the ADC dynamic margin, changing the optical components of the sensor modules implies modifying the module circuitry.

There is a need for solving these problems in order to improve the performance of current and new correction systems based on the measurement of droplet placement inaccuracies in printed patterns.

SUMMARY OF THE INVENTION

The present invention provides a selfcalibrated sensor module for inkjet printing devices.

According to the present invention, the sensor module includes a new circuitry and a new calibration method to provide the best output signal independently of optical component functionality variations and external light source influences.

The circuitry for processing the photodetector output signal is designed to process that signal by a bank of amplifiers or by an amplifier of variable gain and includes an input for adding an offset to the signal.

The calibration system, implemented in a processing unit, calibrates the sensor module, firstly finding the level of light that should be applied to the LEDs to maximize it so as to grant the best signal possible, in terms of the signal to noise ratio (SNR), Secondly, it determines which amplification factor will be used in order to ensure that the resulting sampled signal is not saturated. Thirdly, it determines the necessary offset to be added to the signal to center it in the dynamic margin of the ADCs.

DESCRIPTION OF THE INVENTION

The Printer

Figure 1:
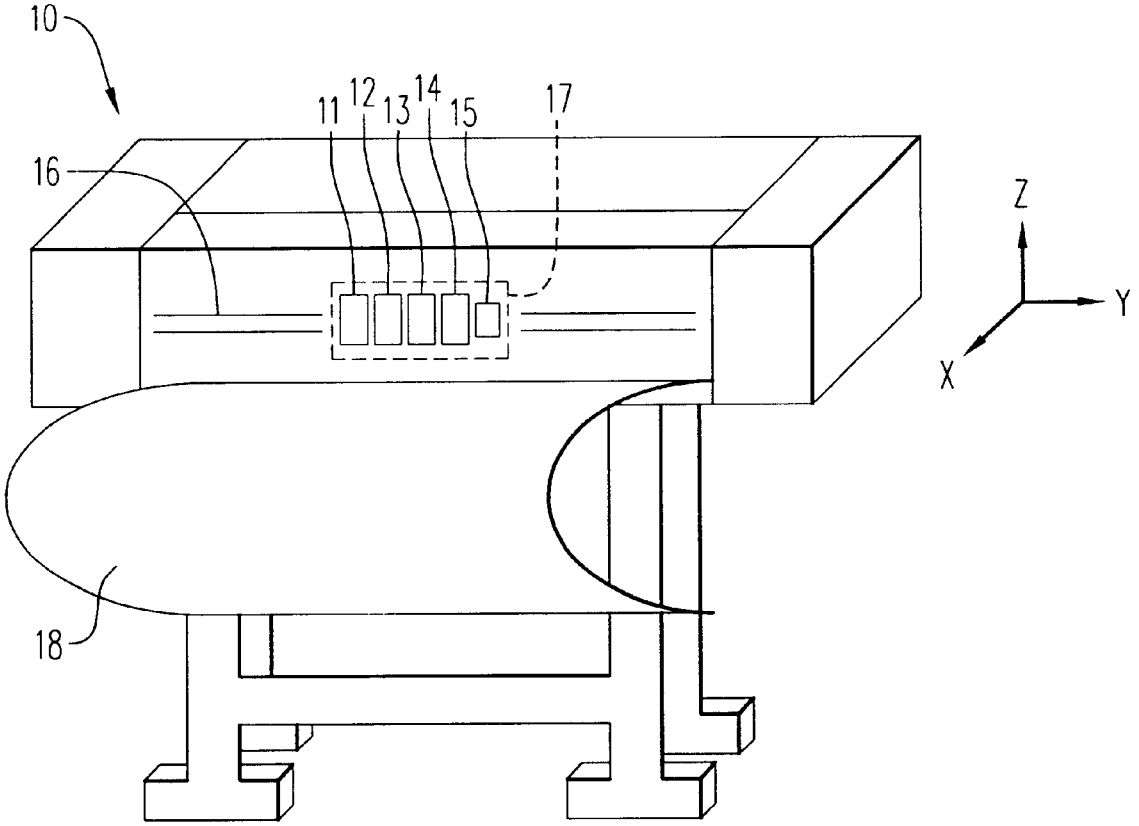
FIG. 1 is a perspective view of an inkjet large format printer/plotter incorporating the teaching of the present invention.

FIG. 1 is a perspective view of an inkjet large format printer/plotter 10 incorporating the teaching of the present invention.

A carriage assembly 17 is adapted for reciprocal motion along a slider rod 16, its position in the scan axis Y being determined by known mechanisms. A media moving assembly, comprising a main drive roller accurately indexing the media along a direction (media axis X) substantially perpendicular to the scan axis Y, over a platen defining a printzone, the area of the printer in which the printhead applies ink on the medium.

The carriage assembly 17 has inkjet pens 11, 12, 13, 14 that fire ink of different colors. As the carriage assembly, moving along the scan axis, traverses the the media 18 moving along the media axis X, selected nozzles in the printheads of pens 11, 12, 13 and 14 are activated and ink is applied to the media 18.

The carriage assembly includes a sensor module 15 and the circuitry (not shown) required for interface to the heater circuits in the pens.

The Sensor Module Known in the Art

The sensor module 15 is a device for measuring printing errors in inkjet printers/plotters caused by pens or print cartridges misalignments and/or other printer component misalignments, sensing appropriated printed patterns on the media 18 and providing electrical signals indicative of said errors which are converted into numerical values. These measures are used in alignment procedures incorporated to the printer for the correction of said errors.

Figure 2:
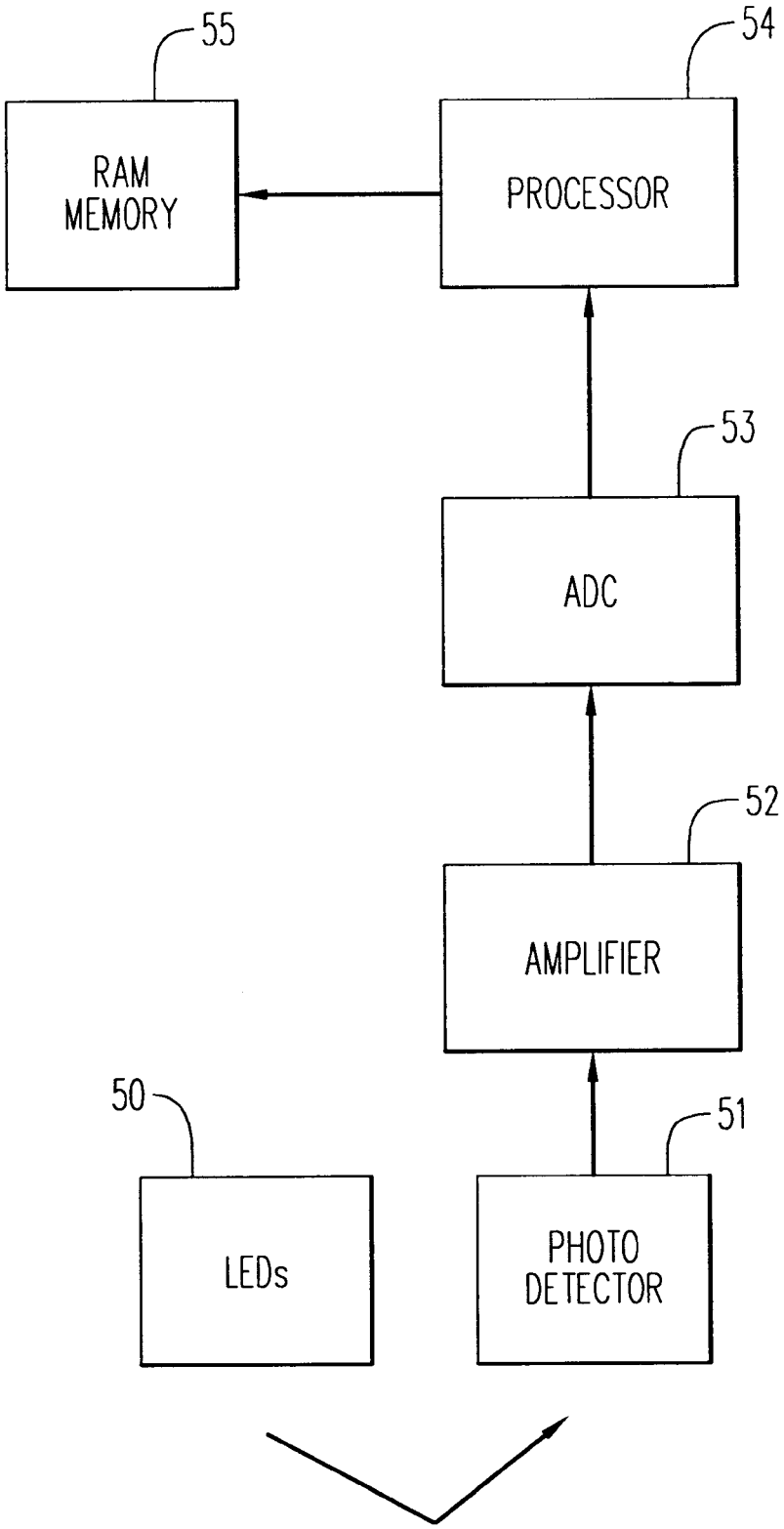
FIG. 2 is a schematic representation of a sensor module known in the art.

As illustrated schematically in FIG. 2, the sensor module known in the art includes a green and a blue light emitting diodes (LEDs) 50 for illuminating an appropriate test pattern and a photodetector 51. As the sensor module scans said test pattern, output electrical signals are provided by the photodetector and processed by a circuitry to obtain the printing error measures.

Said circuitry includes an analogue circuit 52 for amplifying said output signals, an analog-to-digital converter, ADC, 53 for sampling said signals and a processor 54 for computing the resulting set of samples from the ADC and storing the numerical measures of the printing errors in a RAM memory 55.

The Sensor Module Calibration Method According to the Present Invention

Figure 3:
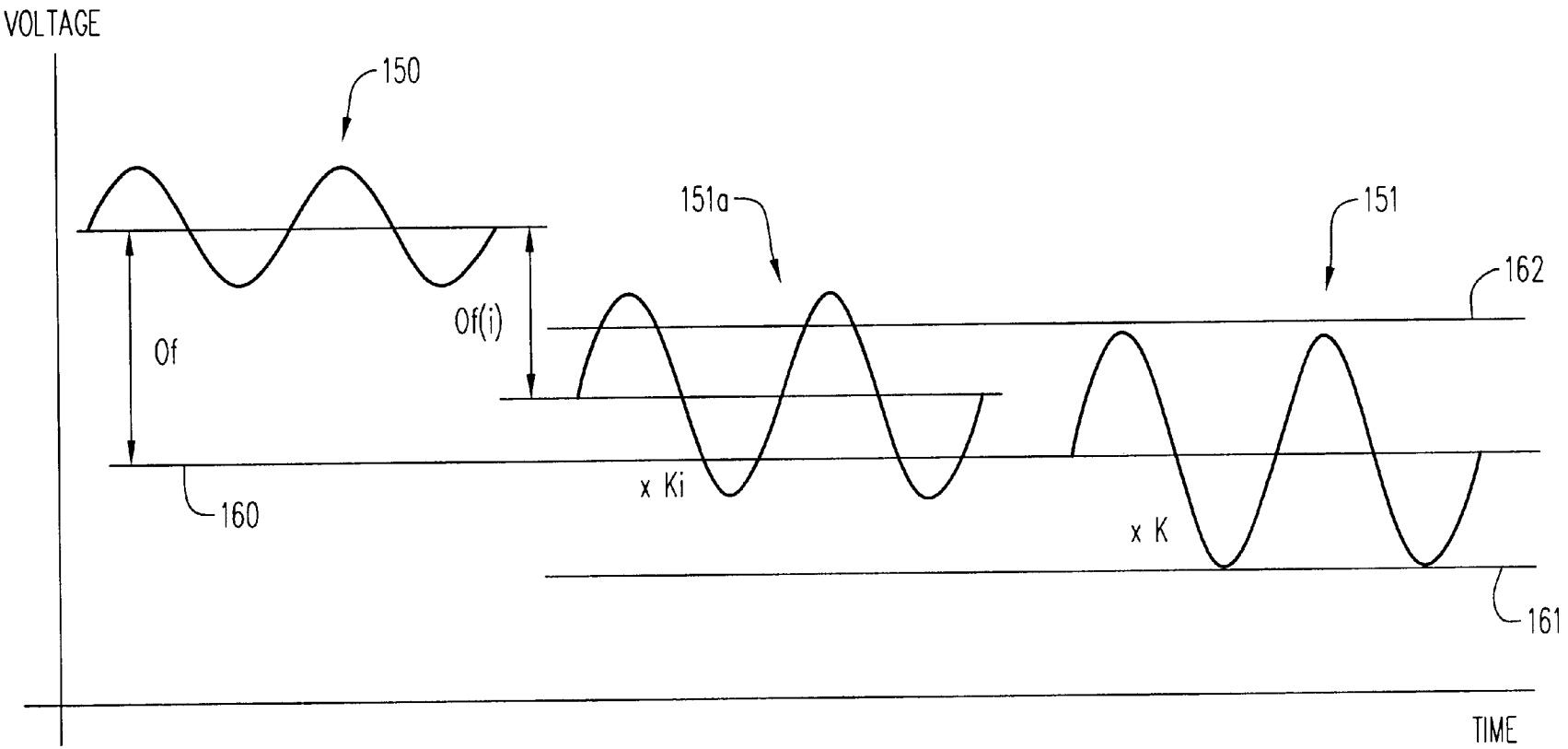
FIGS. 3 and 4 show the application of a gain and an offset to the photodetector output signal.

In FIG. 3 the represented electrical signal 150 is produced by the photodetector when the sensor module scans a particular surface illuminated by a light source and the signal 151 which best adapts to the dynamic margin of the ADC indicated with the lines 161 and 162, guaranteeing, therefore, the best possible conversion of the signal into digital data.

According to the method of the present invention capability of a sensor module to perform selfcalibration is achieved, i.e. the means involved in the generation and the process of the signal 150 are used for obtaining the signal 151.

The amplitude of the signal 150 depends on the intensity of the light source and, as indicated in FIG. 3, its transformation into the signal 151 requires applying an amplification in a factor K and and an offset Of.

Hence, the calibration parameters are the level of intensity of the light source, the level of amplification of the signal and the offset necessary to center it in the dynamic margin of the ADC.

To obtain said parameters firstly an appropriate test pattern is printed to validate the intensity of the light source.

Secondly, the test pattern is scanned and the degree of saturation of the electrical signals generated by the photodetector in the ADC is analyzed for different levels of intensity of the light source and applying to the signals different levels of amplification and different offsets. That is, the degree of saturation would be analyzed of signals such as signal 151*a* with an amplification factor Ki and an offset Of(i). In such signal a saturation would be produced in the high level of the ADC. When the circumstances are present which generate the signal 151 the desired calibration has been achieved and the three mentioned parameters are applied to the corresponding means.

A preferred embodiment of the method will next be explained in detail, utilizing four amplification channels, which obtains said calibration parameters, for a source of light—a light emitting diode (LED)—through an iterative process of scanning an appropriate test pattern, analyzing the resulting samples and applying corrections until achieving the level of light for obtaining the best possible sampled signal in terms of Signal to-noise-ratio (SNR), which of the four amplification channels will be used in order to ensure that the resulting sampled signal is not saturated and the necessary offset to be added to the signal to center it in the dynamic margin of the ADC.

Figure 4:
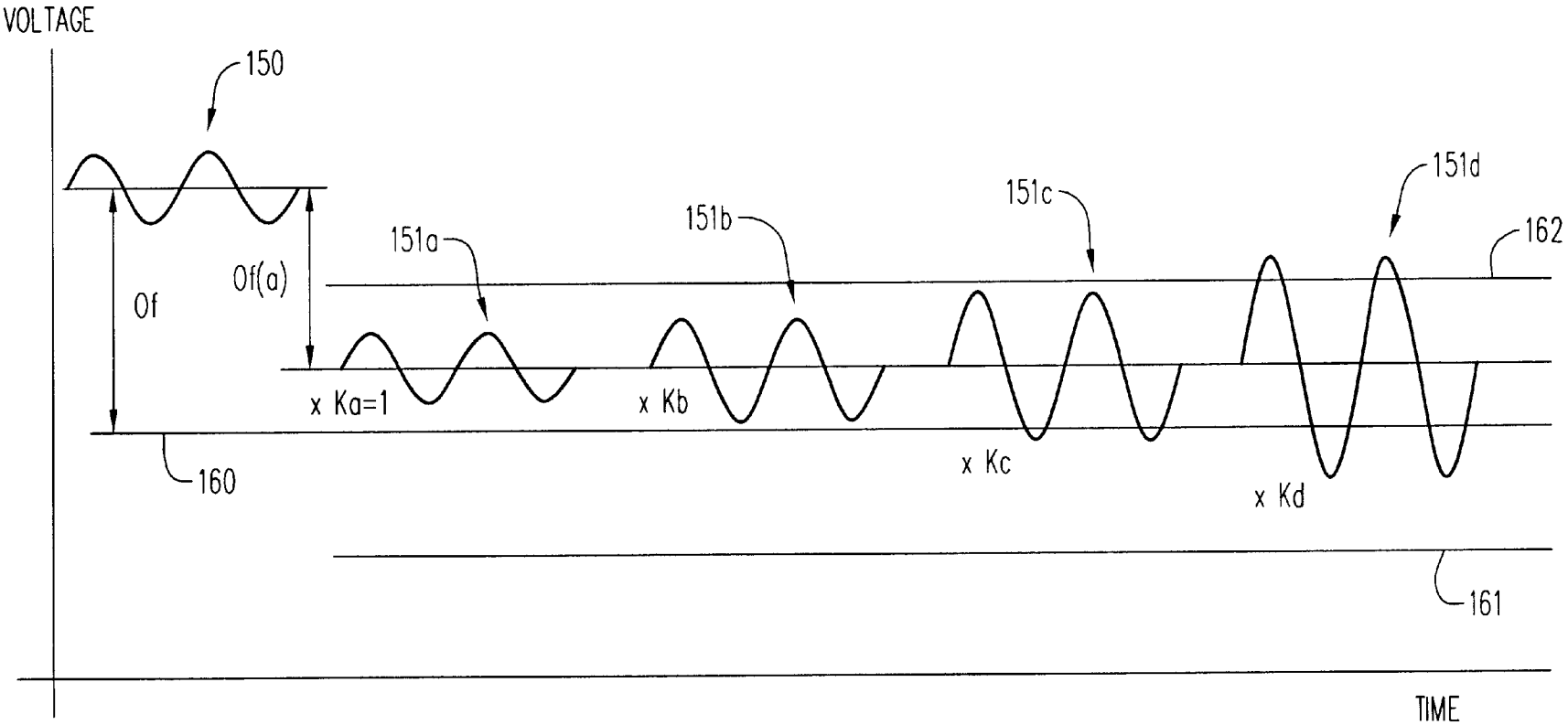

Following the example shown in FIG. 4 and assuming that output signals like 150 have been generated with the calibrated LED level of light, the method would analyze the saturation of signals like 151*a*, 151*b*, 151*c* and 152*d* in the four amplification channels and, once the appropriate level were found in any of them, would correct the offset Of(a) until obtaining the value Of that centers the signal in the virtual zero 160 of the ADC.

Figure 5:
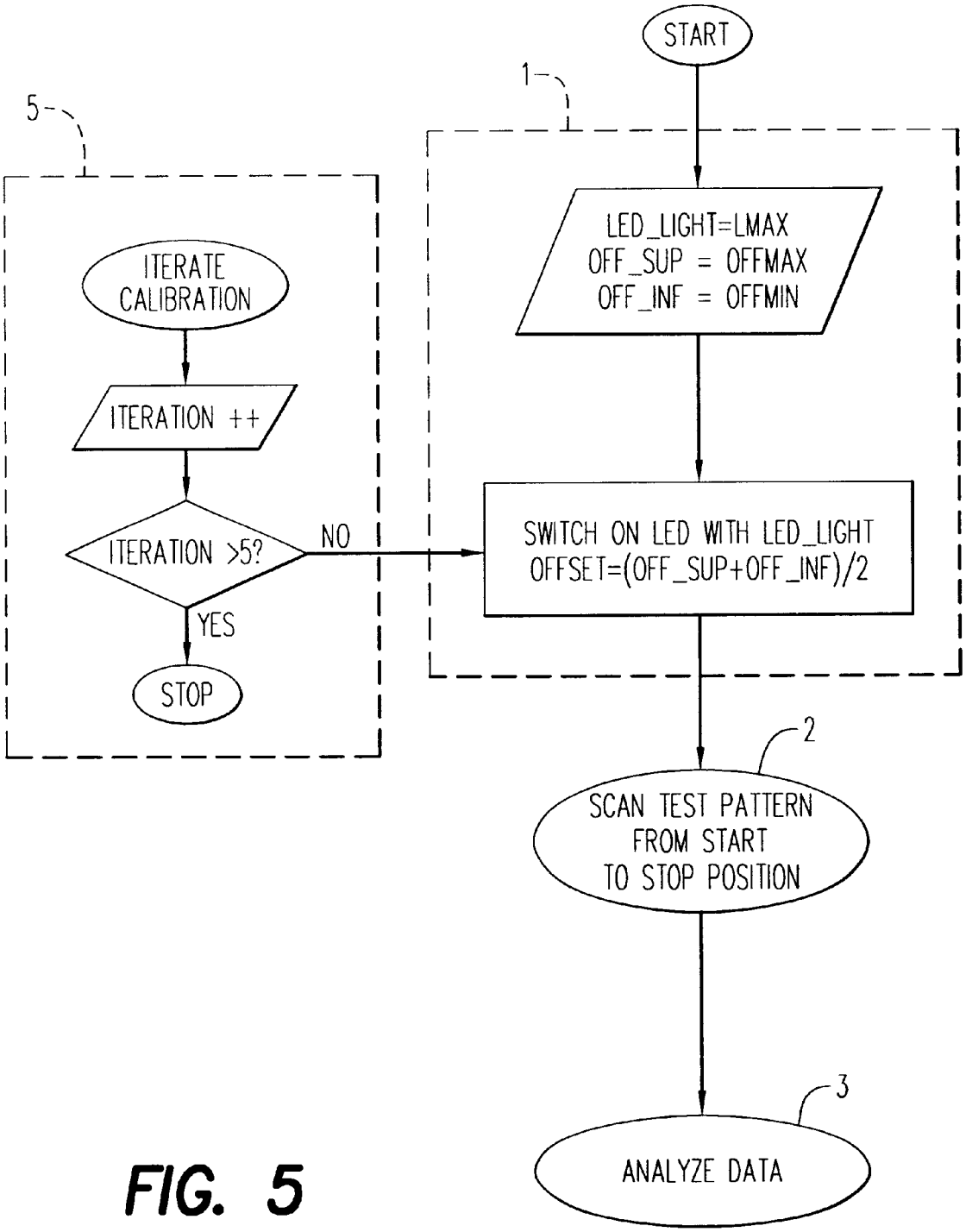
FIGS. 5, 6 and 7 show a detailed flowchart of a sensor module calibration method according to the present invention.
Figure 6:
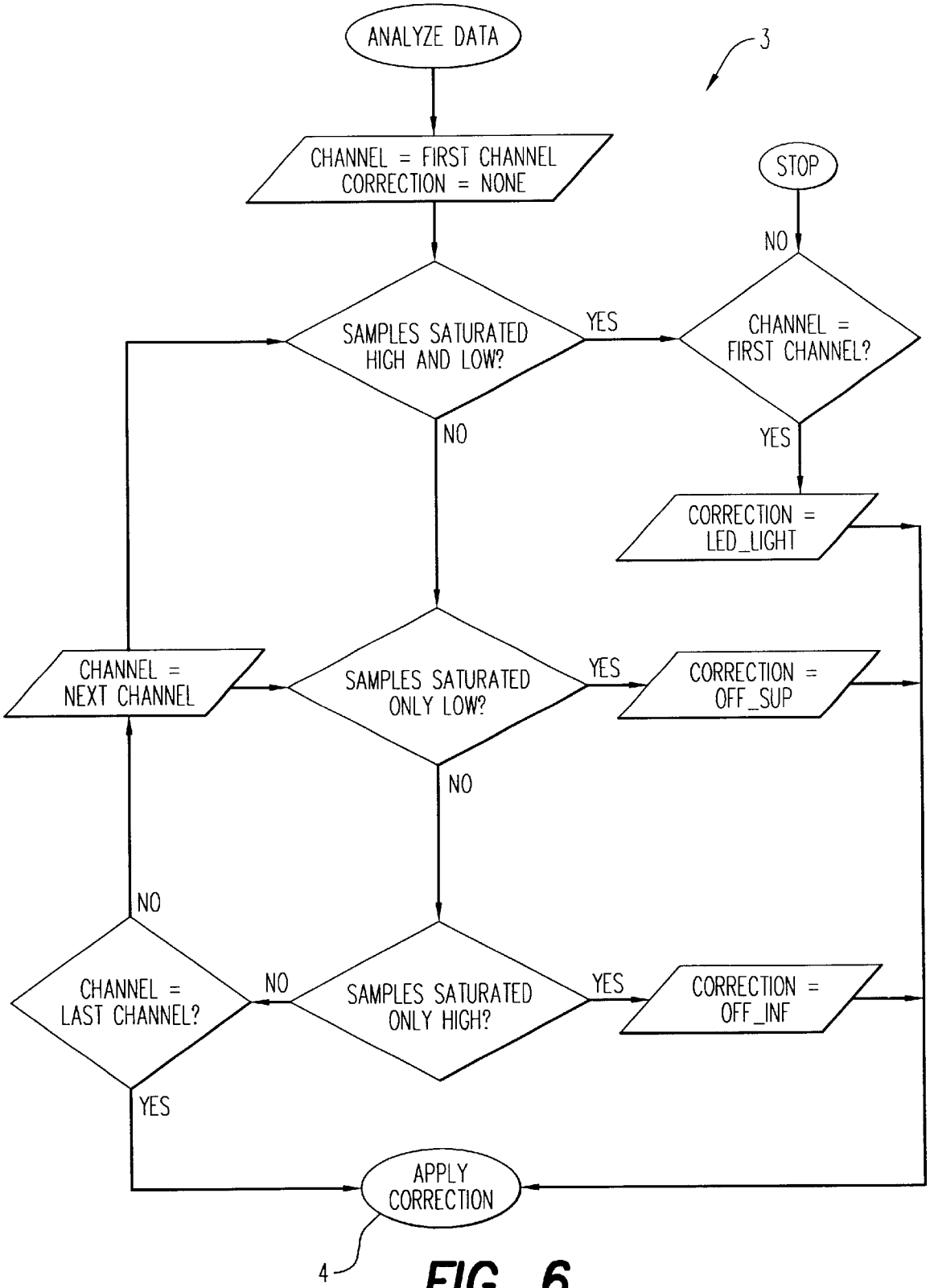
Figure 7:
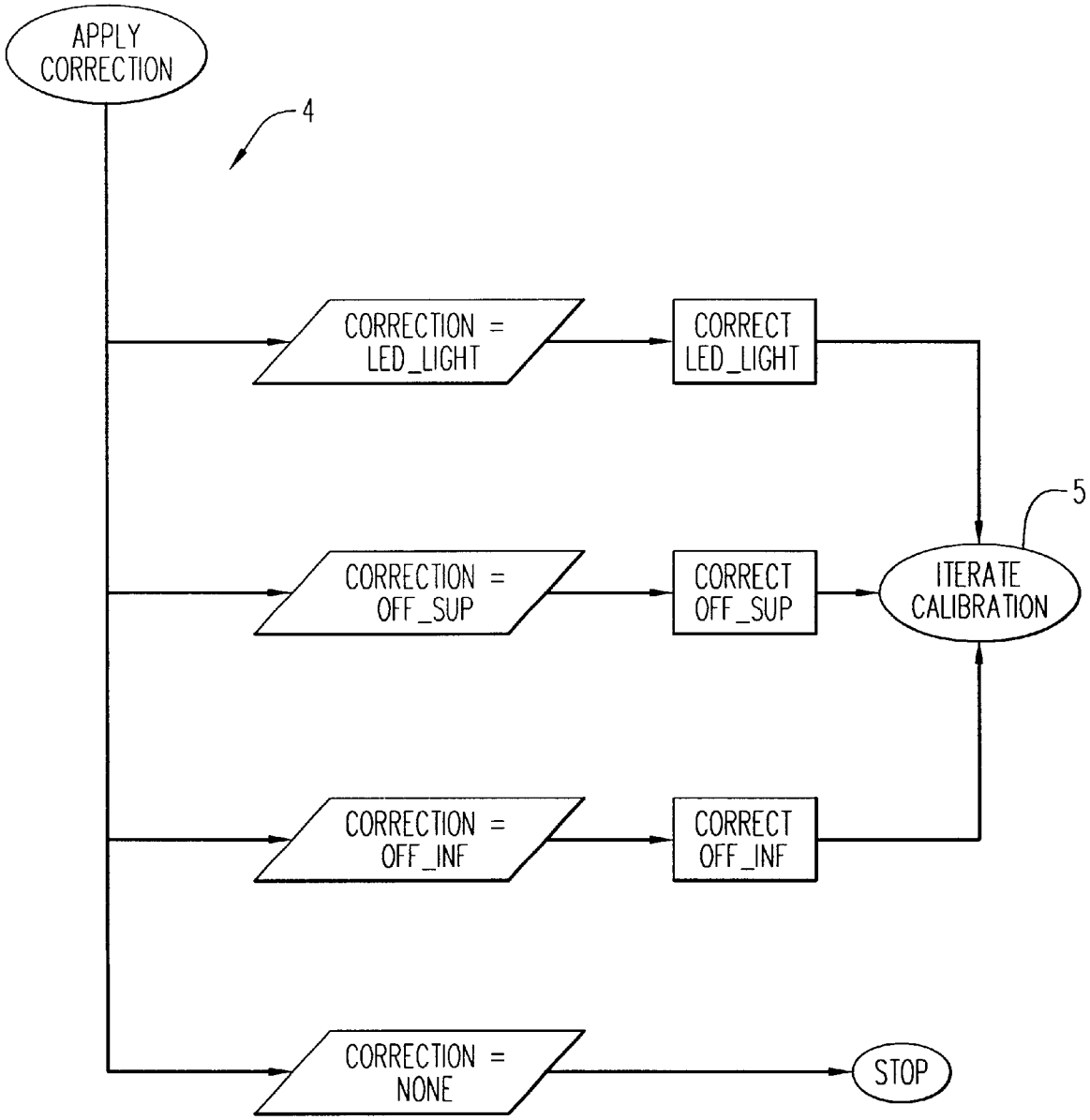

FIGS. 5, 6 and 7 show a detailed flowchart of the method.

In step 1, LED is switched on with the level of light LED_LIGHT and the OFFSET to be applied to the photodetector output signal is calculated as the average of auxiliary parameters OFFSET_SUP and OFFSET_INF. The initial value of LED_LIGHT is set to its maximum value LMAX. The initial values of OFFSET_SUP and OFFSET_INF are set to values OFFMAX and OFFMIN, the offset values for white and black surfaces, respectively.

Figure 8:
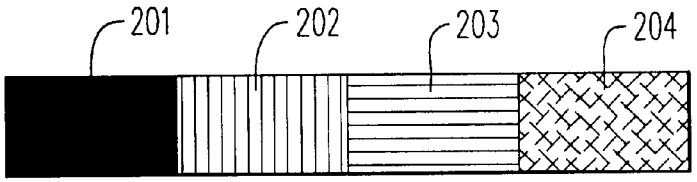
FIG. 8 illustrates a test pattern that can be used in a sensor module calibration method according to the present invention.

In step 2, a test pattern is scanned from the start to the stop position and samples are acquired through the four amplification channels for a further analysis. FIG. 8 shows an appropriate test pattern for the sensor module calibration method: blocks 201, 202, 203 and 204 printed with the black, magenta, cyan and yellow pens.

In step 3, the saturation of the resulting set of samples is analysed identifying the first channel that requires a correction and the parameter to be corrected. The LED level of light, LED_LIGHT, needs a correction when the first amplification channel acquires saturated samples. OFF_SUP needs a correction when any of the channels acquires saturated samples at the low margin of the ADC. Similarly OFF_INF needs a correction when any of the channels acquires saturated samples at the high margin of the ADC.

The saturation analysis is made comparing the samples with a given threshold, i.e. a sample is saturated high when is it larger than the threshold and saturated low when it is lower than the threshold, and obtaining percentages of samples saturated high and low acquired when scanning the test pattern in each channel. For the purpose of the present method it is considered that a channel saturates high when the number of saturated samples at the high margin is higher than 10% and saturates low when the number of saturated samples at the lower margin is higher than 23%.

In step 4 corrections are applied and an iteration step 5 is performed after applying any correction. The process terminates when no corrections are applied or when five iterations have been carried out; in this case, the calibration parameters are taken from the values obtained for the previous channel.

As said before, the saturation of the first channel indicates that the LED level of light must be reduced so the correction of LED-LIGHT is made decreasing its previous value.

The correction of OFF_SUP should result in an increment of OFF-SUP as the saturation only low indicates that the offset applied is too low. The new value of OFF_SUP is calculated as the average of OFF INF and OFFSET.

Similarly, the correction of OFF_INF should result in a decrease of OFF-INF as the saturation only high indicates that the offset applied is too high. The new value of OFF_INF is calculated as the average of OFF_SUP and OFFSET.

Figure 9B:
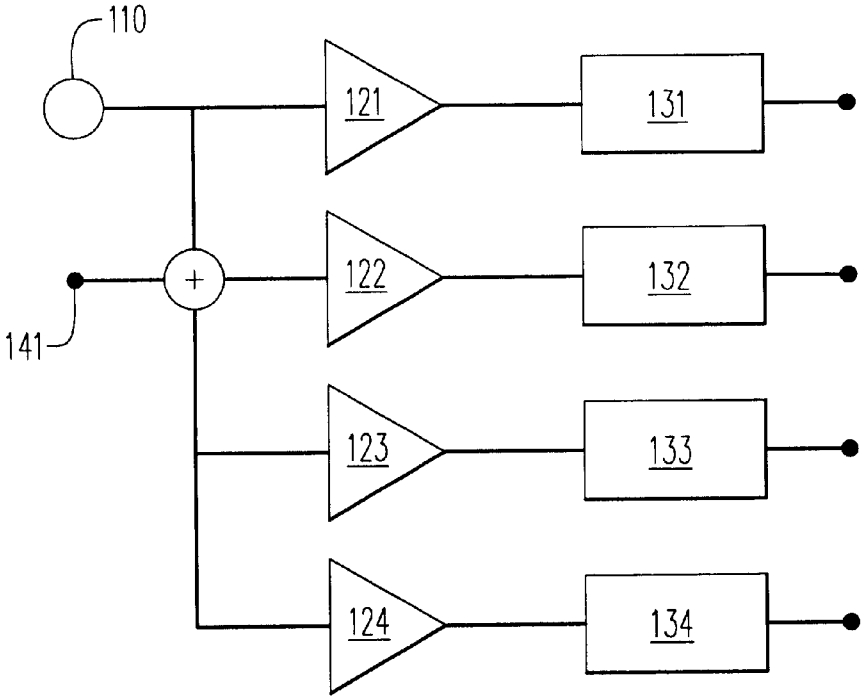
FIG. 9B is a schematic representation of the signal amplification and sampling means used in a sensor module according to the present invention.
Figure 9A:
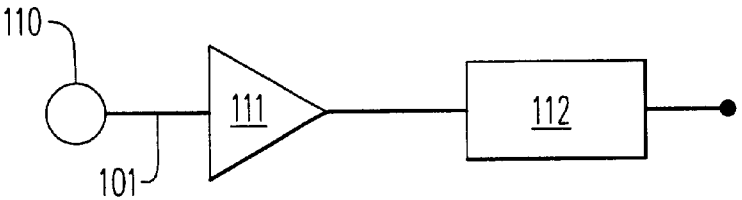
FIG. 9A is a schematic representation of the signal amplification and sampling means used in the sensor module known in the art.

A Sensor Module Incorporating a Calibration Method According to the Present Invention In the sensor module known in the art two LEDs are used, one green and the other blue and, for each of them, as shown in FIG. 9A, the electrical signal 101 produced by the photodetector 110 is amplified with a fixed gain K in amplifier 111 and sampled with ADC 112.

A sensor module incorporating the method subject of the present invention will continue having the general configuration represented in FIG. 2, but will utilize different amplification means. In this respect, FIG. 9B shows the means utilized in the preferred embodiment of the method described above which includes a bank of four amplifiers 121, 122, 123, 124 connected to four channels 131, 132, 133, 134 of an ADC and an input 141 for adding an offset to the signal.

An amplifier having variable gain may substitute the bank of four amplifiers of the above described preferred embodiment of the present invention. A person skilled in the art will easily understand the changes to be introduced in the calibration method to find the amplification factor to be applied in order to ensure that the resulting sampled signal are not saturated.

Figure 10:
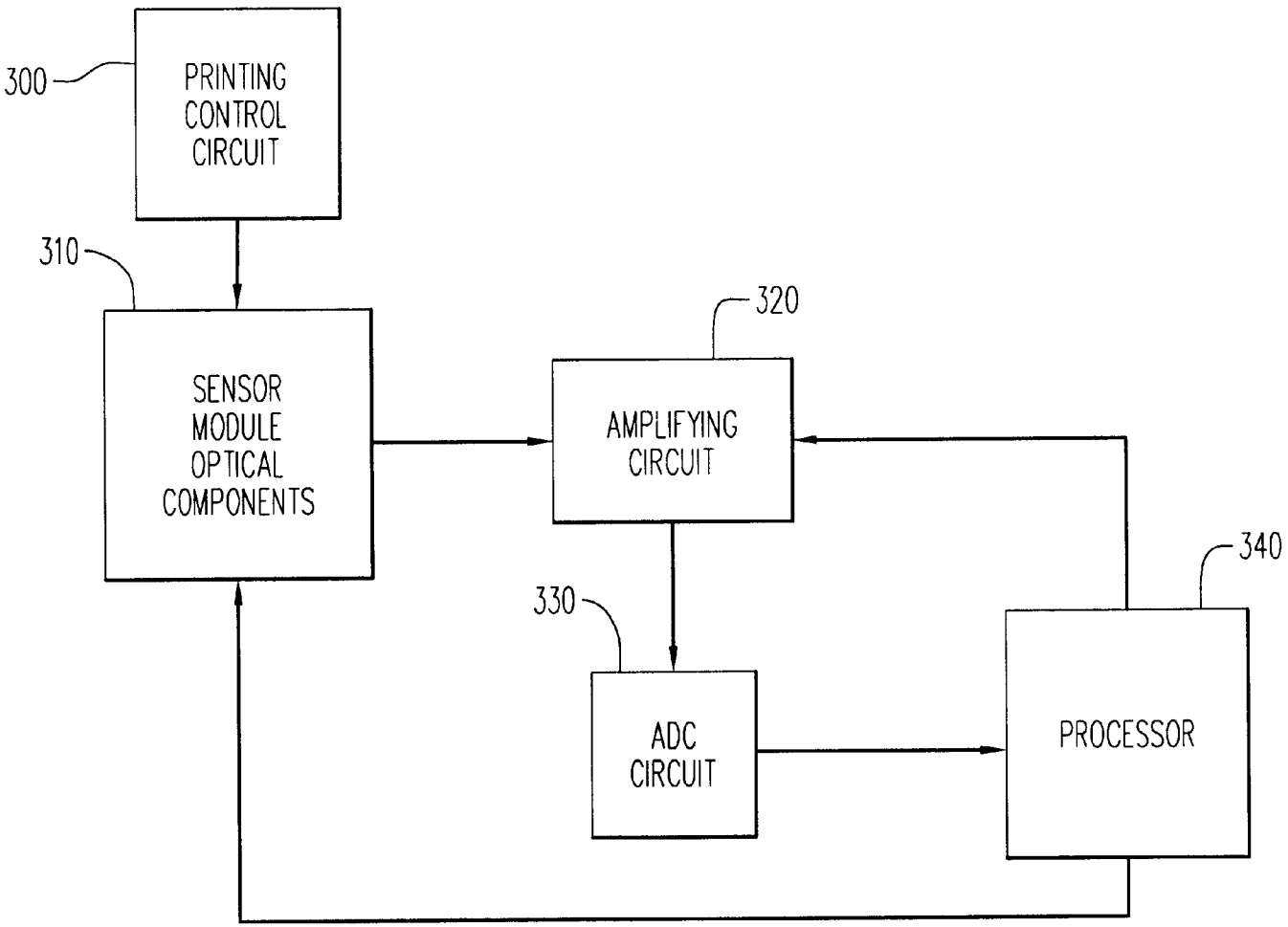
FIG. 10 is a schematic block diagram of the electronics for implementing the sensor module calibration method of the present invention.

The electronics for implementing the calibration method of the present invention is schematically shown in the block diagram of FIG. 10.

A circuit 300 allows the printing of the desired test pattern which is scanned with the sensor module optical components 310, providing a signal which is processed in circuit 320 and sampled in circuit 330.

A processor 340 is programmed to perform the above described method, analysing said samples and providing the calibration parameters to circuit 320 and to LEDs in 310.

Use of the Sensor Module According to the Present Invention

The method of calibration of the sensor module will generally be performed each time there is a need to use the sensor module to scan a particular printed matter and obtain certain data regarding said printed matter.

This occurs in alignment procedures incorporated into the inkjet printer/plotter and intended for the correction of printing errors, which include the scanning of particular test patterns and the measurement of errors manifested in said test patterns. Accordingly, in these procedures a prior step will be included for calibration of the sensor module in order to guarantee its optimized operativity. In these cases, there shall be used, as appropriate test pattern for calibration of the sensor module, one of the test patterns used to make evident the printing errors that should be corrected in the alignment process in question as explained above.

For sensing other kind of references, a prior step of calibration of the sensor module, using more appropriate patterns, shall likewise be performed.

In a further embodiment, the sensor module is calibrated by using references available on the printer itself without any need of printing particular test pattern. For instance, a mark may be placed on the main drive roller of the printer in order to allow the calibration of the roller movements. It may happen that the sensor may need an additional calibration procedure, due to the size, the color and the location of the mark, e.g. a small white mark placed on a dark surface, which has to be rotated to show the mark, and close to a deep gap. This procedure will be similar to the previous one, but it will use different references as a pattern for calibration. In this case the intensity of the light source is calibrated by scanning and measuring an end portion of the black printing platen and the gap between said end and the frame of the printer. Thus the intensity of the two LEDs is then adjusted until the sensor will be able to distinguish as two different signals, the light reflected by the black plastic platen and the light 'not' reflected by the gap, which is used as an absolute calibrating reference.

In a further embodiment, a similar calibration process may be performed on the optical sensor before attempting to sense references available on printhead cleaners, or other components available in the printer.

Advantages of a Sensor Module According to This Invention

According to the present invention, the sensor module includes a new circuitry and a new calibration method to provide the best output signal independently of optical component functionality variations and external light source influences. Therefore the sensor module has a selfcalibration capability allowing the use of different LEDs and/or photodetector and also the performance of alignment procedures in different light working conditions. A notably important difference with respect to the prior art is that a single LED can be also used as light source, e.g. white light LED.

The sensor module of the present invention has been tested with different light working conditions and replacing the LEDs and the photodetector. The results have confirmed its selfcalibration capability.

While exemplary and preferred embodiments of the invention have been shown and described, it will be appreciated by those skilled in the art that various modification and revisions can be made without departing from the spirit and scope of the invention as set forth in the following claims.

What is claimed is:

1. A method for calibrating a sensor module of an inkjet printing device comprising at least one light source for transmitting light, having certain spectral characteristics, to a surface, a light detector for converting the light reflected by said surface into data, said method comprising:

transmitting light to an appropriate reference placed on said surface;

measuring the light reflected by said reference; and responsive to measuring the light reflected by said reference, generating adjustment values for a plurality of calibration parameters applied to said sensor module.

2. The method of claim 1, wherein said appropriate reference placed on said surface is a test pattern printed on a medium.

3. The method of claim 2, further comprising printing said test pattern on a medium before measuring the light reflected by said reference.

4. The method of claim 3, further comprising applying said adjustment values to adjust said data generated by said light detector, so that said data are independent from the characteristics of light transmitted by said at least one source.

5. The method of claim 4, further comprising:

analyzing a degree of saturation of said light detector for different intensity levels of said at least one source of light; and applying to said data different amplification levels and offsets.

6. The method of claim 5, wherein said calibration parameters comprise an intensity to apply to said at least one source of light, a level of amplification and an offset to apply to said data for adapting said data to a maximum range of said sensor module.

7. The method of claim 6 wherein said level of amplification comprises at least one of a fixed number of amplification levels.

8. The method of claim 7, wherein said level of amplification comprises at least one of four amplification levels.

9. The method of claim 1, wherein said appropriate reference comprises one or more marks available on said surface.

10. The method of claim 1, further comprising transmitting light to an empty space, so that by not receiving any reflected light, an absolute reference is obtained and used for generating said adjustment values.

11. An inkjet printing device comprising:

a sensor module having:

at least one light source for transmitting light, having certain spectral characteristics, to a surface;

a light detector for converting the light reflected by said surface into data; and adjusting means, responsive to data supplied by said light detector, for generating adjustment values for a plurality of calibration parameters applied to said sensor module, based on said data.

12. The device of claim 11, wherein said adjusting means comprises means to vary an intensity of said transmitted light in accordance with said adjustment values.

13. The device of claim 12, wherein said surface is a surface of said device.

14. The device of claim 13, further comprising a reference available on said surface, wherein said light detector converts the light reflected by said reference into data.

15. The device of claim 14, further comprising at least an empty space, said light detector using said empty space as an absolute reference for generating data.

16. The use of a dynamically calibratable sensor module in alignment procedures for correcting printing errors, caused by any inkjet printing device component misalignment, which includes a step of measuring said errors in appropriate test patterns.

17. The use of a dynamically calibratable sensor module according to claim 16 for locating the position of one or more given references available on said device.

* * * * *